US007000509B2

(12) United States Patent
Shiao

(10) Patent No.: US 7,000,509 B2
(45) Date of Patent: Feb. 21, 2006

(54) HAND TOOL WITH A REMOVABLE ROTARY BIT RECEIVING CASSETTE

(76) Inventor: Hsuan-Sen Shiao, No. 55, Cheng-Feng Lane, Tai-Ming Rd., Wu-Jih Hsiang, Taichung Hsien (TW)

( * ) Notice: Subject to any disclaimer, the term of this patent is extended or adjusted under 35 U.S.C. 154(b) by 126 days.

(21) Appl. No.: 10/796,026

(22) Filed: Mar. 10, 2004

(65) Prior Publication Data

US 2005/0092144 A1 May 5, 2005

(30) Foreign Application Priority Data

Oct. 31, 2003 (TW) ..... 92130538 A

(51) Int. Cl.
*B25G 1/08* (2006.01)

(52) U.S. Cl. ..... 81/490; 81/177.4; 81/439

(58) Field of Classification Search ..... 81/439, 81/177.4, 490, 438

See application file for complete search history.

(56) References Cited

U.S. PATENT DOCUMENTS

| | | | | |
|---|---|---|---|---|
| 6,134,995 | A * | 10/2000 | Shiao | 81/439 |
| 6,502,484 | B1 * | 1/2003 | Pao-Hsi | 81/439 |
| 6,601,483 | B1 * | 8/2003 | Wannop | 81/490 |
| 6,684,740 | B1 * | 2/2004 | Lin | 81/438 |

* cited by examiner

*Primary Examiner*—Lee D. Wilson
*Assistant Examiner*—Alvin J. Grant
(74) *Attorney, Agent, or Firm*—Berenato, White & Stavish, LLC.

(57) ABSTRACT

A hand tool includes a handle defining an axially extending passage therein, and having an accommodation cavity with a radially extending access opening. A cassette member is insertable through the opening to be rotatably mounted in the cavity, and has a plurality of angularly displaced storage chambers for receiving tool bits, respectively, such that a selected one of the chambers is in line with the passage. A shank is movably disposed in the passage, and has an engaging head which can push the tool bit in the selected chamber outwardly of the handle for operation, and which can be retracted into the passage for angular movement of the chambers. The cassette member can be radially pushed to be removed from the cavity through the opening.

9 Claims, 13 Drawing Sheets

HAND TOOL WITH A REMOVABLE ROTARY BIT RECEIVING CASSETTE

CROSS-REFERENCE TO RELATED APPLICATION

This application claims priority of Taiwanese Application No. 092130538, filed on Oct. 31, 2003.

BACKGROUND OF THE INVENTION

1. Field of the Invention

This invention relates to a hand tool, more particularly to a hand tool with a removable rotary cassette member for receiving tool bits.

2. Description of the Related Art

FIGS. 1 and 2 show a hand operated tool with a removable rotary bit retaining member, which is disclosed in U.S. Pat. No. 6,134,995 granted to the applicant of the present invention. The hand operated tool includes a tubular casing 1 having a casing body 101 and a cover member 102 which cooperatively define a receiving space 103. A mounting axle 104 extends from the casing body 101 coaxially into the receiving space 103. A bit retaining member 2 is inserted removably into the receiving space 103, is sleeved rotatably on the mounting axle 104, and has a plurality of storage chambers 201 which are angularly displaced from one another about the mounting axle 104 for receiving tool bits 4. A push rod 3 has a bit pushing portion 301 which extends slidably through the cover member 102, and a magnet 302 which is disposed on the bit pushing portion 301 to magnetically attract the tool bit 4 in a selected one of the storage chambers 201 so as to move the selected tool bit 4 outwardly of a non-circular through hole 105 in the casing body 101 to operate on a workpiece.

When it is desired to remove the bit retaining member 2 from the receiving space 103 for replacement, the cover member 102 is required to be unlocked from and turned relative to the casing body 101 so as to form an access opening for movement of the bit retaining member 2 therethrough. The operation is relatively inconvenient to conduct.

SUMMARY OF THE INVENTION

The object of the present invention is to provide a hand tool with a rotary cassette member which can be replaced conveniently, thereby increasing the number of assorted tool bits that can be applied thereto.

According to this invention, the hand tool includes a handle, a cassette member, a shank, and a handgrip.

The handle includes front and rear segments opposite to each other in a longitudinal direction, and an intermediate segment interposed between the front and rear segments. The handle has a passage extending through the front, intermediate and rear segments along a first axis in the longitudinal direction. The intermediate segment has an access opening which extends in a direction radial to the first axis to be communicated with the passage so as to form an accommodation cavity, and an operating hole which is formed therethrough and opposite to the access opening in the radial direction and which is communicated with the accommodation cavity. The intermediate segment has front and rear retaining walls spaced apart from each other in the longitudinal direction to define a crossing path along the first axis.

The cassette member is configured to be insertable through the access opening into the accommodation cavity, and is retained between and is rotatable relative to the front and rear retaining walls about a second axis that is oriented in the longitudinal direction and that is offset from the first axis. The cassette member has a plurality of storage chambers that are adapted to receive a plurality of tool bits, respectively, and that are displaced angularly from one another about the second axis such that when the cassette member is rotated about the second axis, the storage chambers are successively brought into the crossing path so as to have a selected one of the storage chambers in line with the passage, thereby placing a corresponding selected one of the tool bits in a standby position.

The shank includes an engaging head and a gripped end opposite to each other in the longitudinal direction. The shank is disposed in the passage to be displaceable among a used position, where the engaging head engagingly pushes the selected one of the tool bits, and extends outwardly of the front segment, a retracted position, where the engaging head retreats into the passage of the rear segment, thereby leaving the selected one of the tool bits behind in the selected one of the storage chambers, and a pick-up position, where the engaging head extends into the selected one of the storage chambers to pick up the selected one of the tool bits for subsequent forward movement to the used position or for subsequent rearward movement to the retracted position.

The handgrip engages the gripped end, and is disposed rearwardly of and is movable relative to the rear segment in the longitudinal direction to thereby bring the shank to one of the used, pick-up and retracted positions.

BRIEF DESCRIPTION OF THE DRAWINGS

Other features and advantages of the present invention will become apparent in the following detailed description of the preferred embodiments of the invention, with reference to the accompanying drawings, in which.

DETAILED DESCRIPTION OF THE PREFERRED EMBODIMENTS

Figure 1:
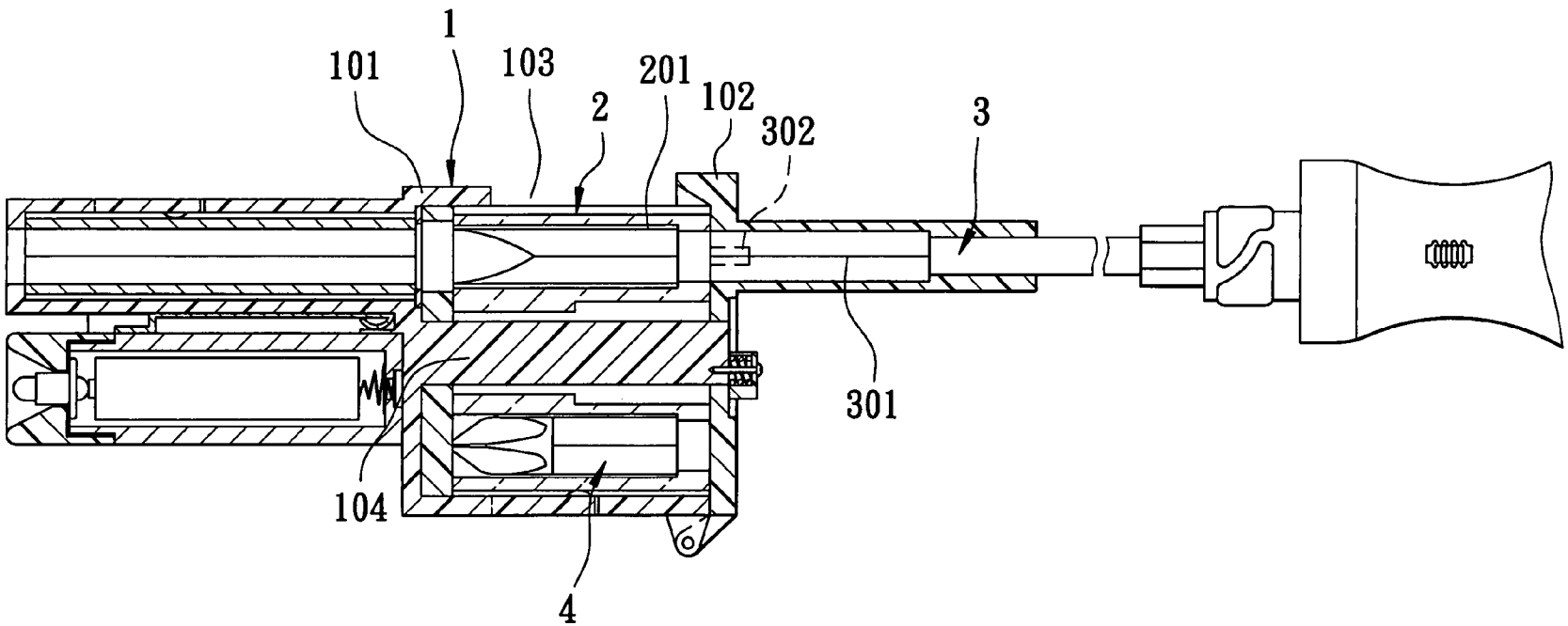
FIG. 1 PRIOR ART
FIG. 1 is a fragmentary sectional view of a conventional hand operated tool in a non-use state.
Figure 2:
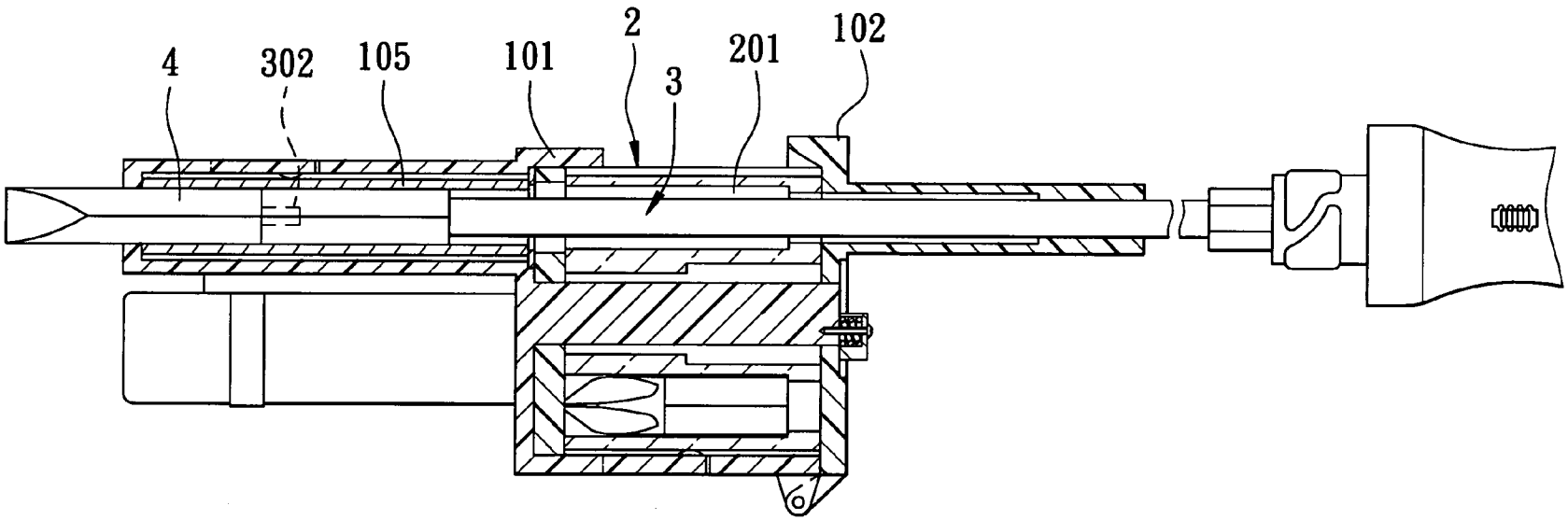
FIG. 2 PRIOR ART
FIG. 2 is a fragmentary sectional view of the conventional hand operated tool in a state of use.
Figure 3:
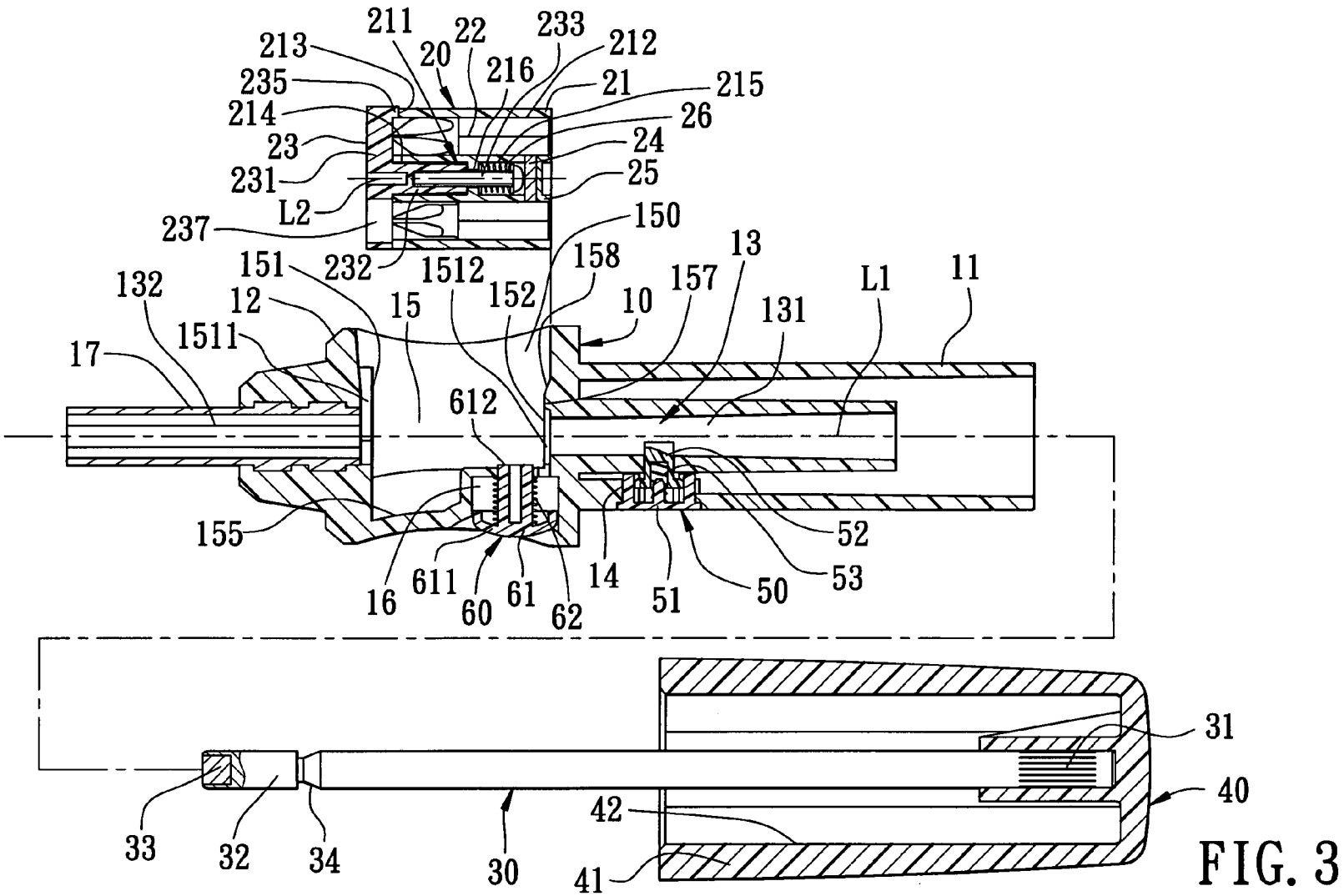
FIG. 3 is an exploded sectional view of a preferred embodiment of a hand tool according to this invention.
Figure 4:
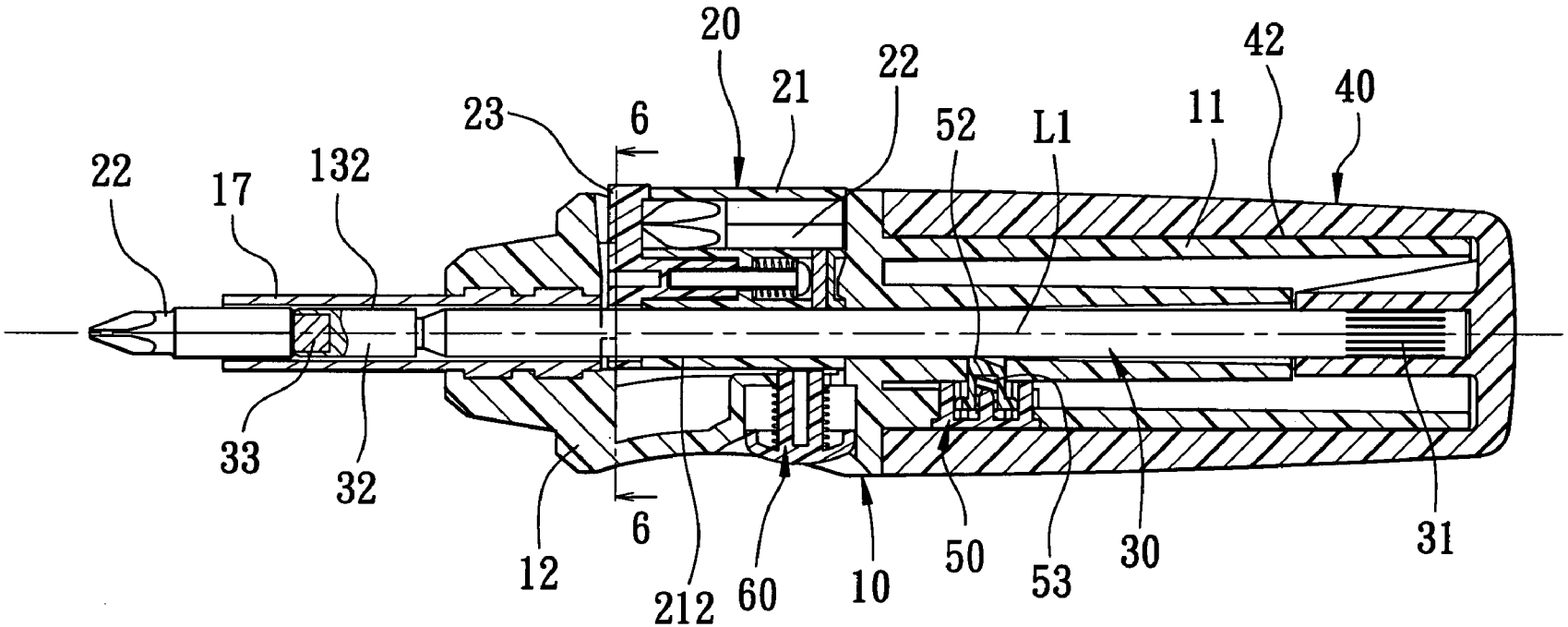
FIG. 4 is a sectional view of the preferred embodiment in a state of use.
Figure 5:
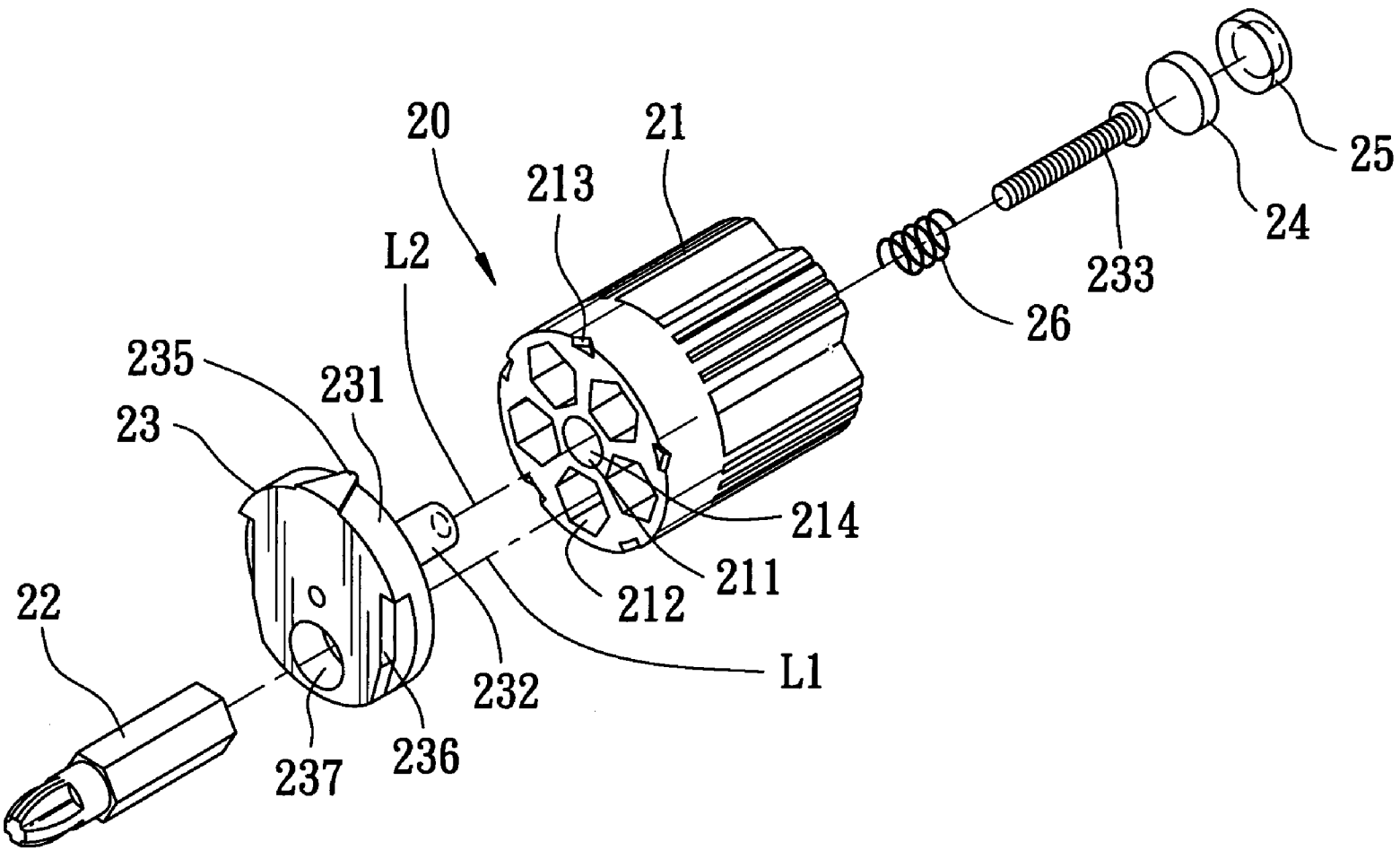
FIG. 5 is an exploded perspective view of a cassette member of the preferred embodiment.

Referring to FIGS. 3 to 5, the preferred embodiment of a hand tool according to the present invention is shown to comprise a tubular handle 10, a cassette member 20, a shank 30, a handgrip 40, a retaining member 50, and an actuating member 60.

Figure 6:
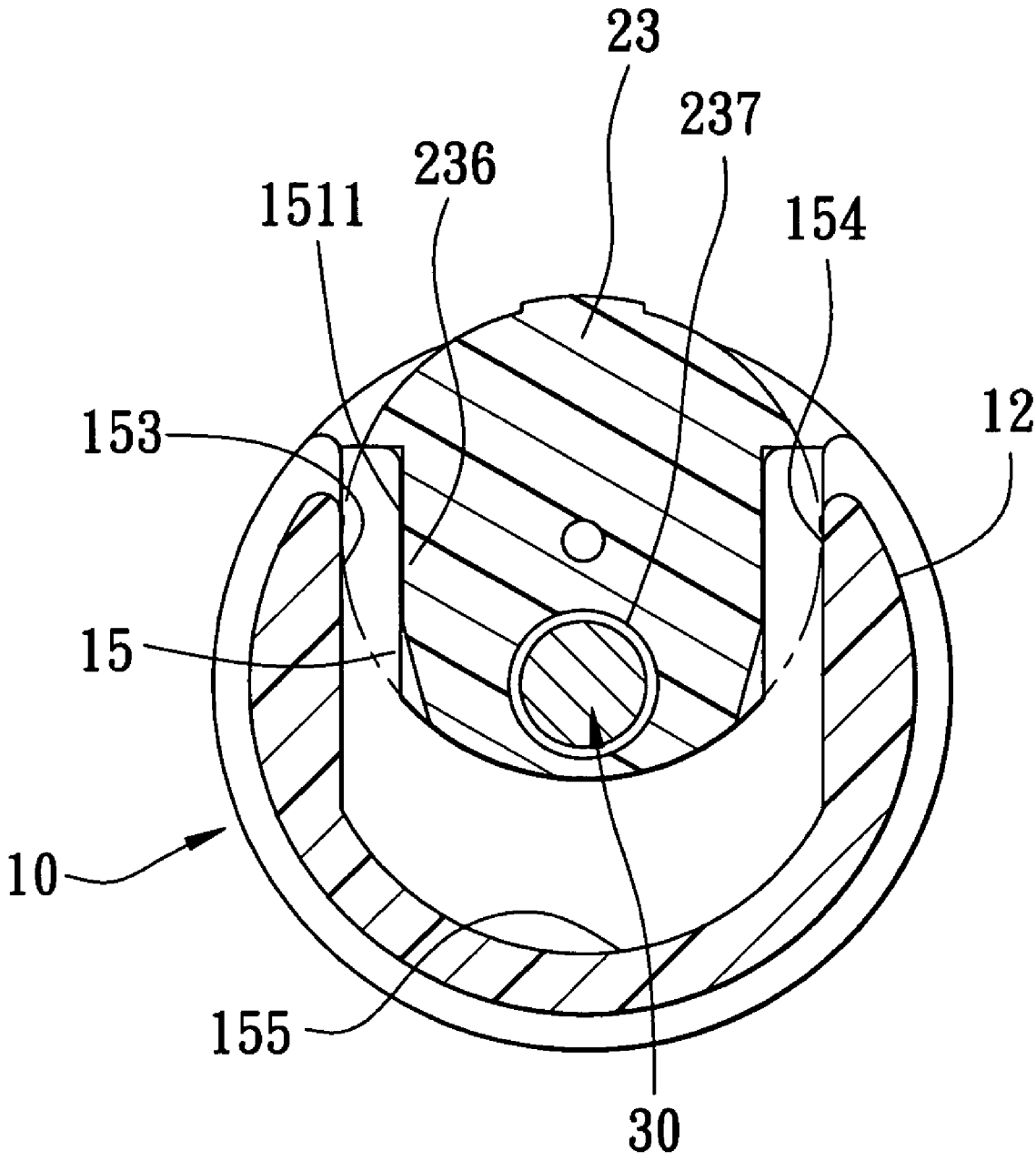
FIG. 6 is a cross-sectional view of the cassette member shown in FIG. 4, taken along lines 6—6 thereof.

The handle 10 includes front and rear segments 17,11 opposite to each other in a longitudinal direction, and an intermediate segment 12 interposed between the front and rear segments 17,11. The handle 10 has a passage 13 extending through the front, intermediate and rear segments 17,12,11 along a first axis (L1) in the longitudinal direction. A front portion 132 of the passage 13 at the front segment 17 has a hexagonal cross-section to be adapted to conform with a cross-section of each tool bit applied thereto. The rear segment 11 has a mounting recess 14 which extends therethrough in a direction radial to the first axis (L1) to be communicated with a rear portion 131 of the passage 13 at the rear segment 11. The mounting recess 14 is a counterbore. The intermediate segment 12 has an access opening 150 which extends in a direction radial to the first axis (L1) to be communicated with the passage 13 so as to form an accommodation cavity 15. The intermediate segment 12 has front and rear retaining walls 151,152 which are spaced apart from each other in the longitudinal direction to define a crossing path along the first axis (L1), and right and left side walls 154,153 and an arcuate bottom wall 155 which are disposed between the front and rear retaining walls 151,152 so as to confine the accommodation cavity 15, as shown in FIG. 6. The bottom wall 155 has an operating hole 16 formed therethrough and disposed opposite to the access opening 150 in the radial direction to be communicated with the accommodation cavity 15. Each of the front and rear retaining walls 151,152 has a retaining recess 1511,1512. The rear retaining wall 152 further has a bump 157 which is disposed above the passage 13 and which has a guiding inclined surface 158 formed thereon.

The cassette member 20 is configured to be insertable through the access opening 150 into the accommodation cavity 15 such that the cassette member 20 is retained between and is rotatable relative to the front and rear retaining walls 151,152 about a second axis (L2) that is oriented in the longitudinal direction and that is offset from the first axis (L1). With reference to FIG. 5, the cassette member 20 includes an abutment seat 23, a cylindrical body 21, a biasing member 26, a magnet 24, and a cap 25.

The abutment seat 23 has an engaging part 231 and a tubular stem 232 extending from the engaging part 231 along the second axis (L2). The engaging part 231 is formed with an engaging portion 236 which is configured to frictionally engage the retaining recess 1511 in the front retaining wall 151 to prevent rotation of the engaging part 231 relative to the front retaining wall 151 about the second axis (L2), and an eccentric through hole 237 relative to the second axis (L2). The eccentric through hole 237 is in line with the passage 13. The stem 232 has a screw hole for receiving a screw bolt 233 therein.

The cylindrical body 21 has an outer periphery which surrounds the second axis (L2), an axial mounting hole 211 which extends along the second axis (L2), and a neck portion 216 which partitions the axial mounting hole 211 into front and rear hole segments 214,215. The stem 232 is inserted into the front hole segment 214 for mounting rotatably the cylindrical body 21 on the stem 232. The biasing member 26 is disposed in the rear hole segment 215 to bias the cylindrical body 21 towards the abutment seat 23. The cylindrical body 21 further has a plurality of storage chambers 212 which are formed between the outer periphery and the axial mounting hole 211, which extend in the longitudinal direction, and which are angularly displaced from one another about the second axis (L2) for receiving a plurality of tool bits 22, respectively. Thus, when the cylindrical body 21 is rotated about the second axis (L2), the storage chambers 212 are successively brought into the crossing path to have a selected one of the storage chambers 212 in line with the eccentric through hole 237, thereby placing a corresponding selected one of the tool bits 22 in a standby position. Furthermore, the engaging part 231 is formed with a triangular protrusion 235 projecting rearwardly. The cylindrical body 21 is formed with a plurality of slots 213 which are angularly displaced from one another about the second axis (L2) such that the protrusion 235 is brought to engage a selected one of the slots 213 by biasing action of the biasing member 26 so as to position the selected one of the storage chambers 212 in the crossing path.

The magnet 24 is disposed in the rear hole segment 215 of the axial mounting hole 211, and is shielded by the cap 25. The magnet 24 has an outer peripheral wall exposed to the storage chambers 212 so as to be adapted for magnetic attraction with the tool bits 22 received in the storage chambers 212.

Figure 7:
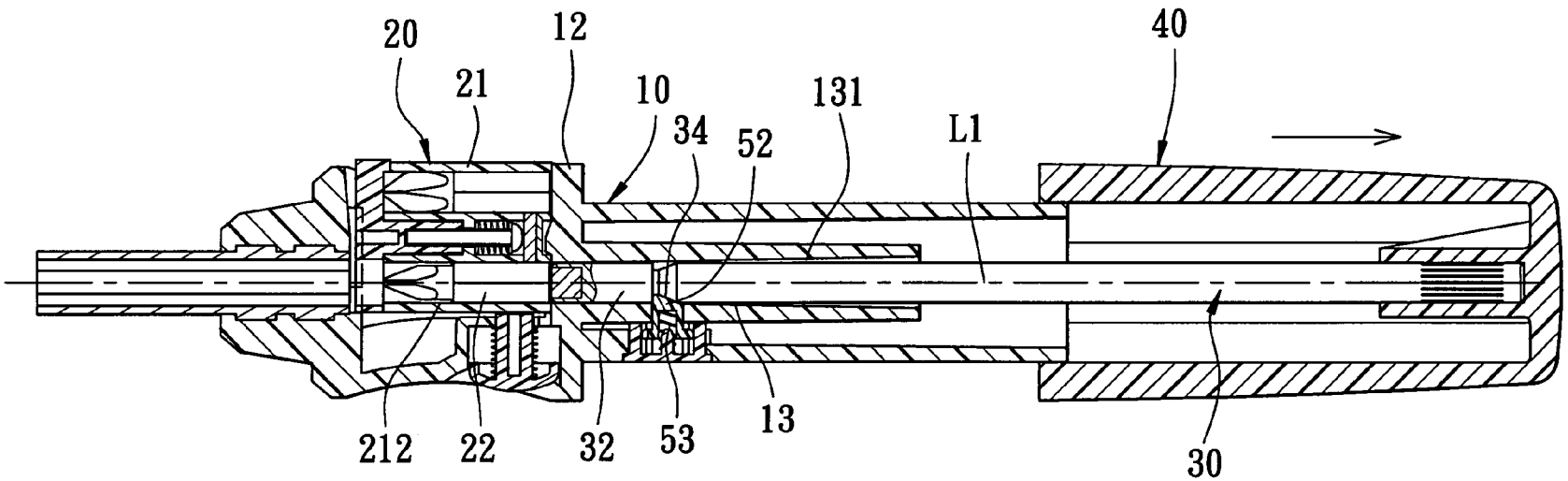
FIG. 7 is a sectional view of the preferred embodiment in a retracted state.

The shank 30 includes an engaging head 32 and a gripped end 31 which are opposite to each other in the longitudinal direction, and is disposed in the passage 13 to be displaceable along the first axis (L1). The engaging head 32 has a magnet 33 provided thereon and facing forwards so as to be adapted for magnetic attraction with the selected one of the tool bits 22 in the standby position, as shown in FIG. 7. Moreover, a retaining slot 34 is formed in the engaging head 32.

The handgrip 40 is connected securely to the gripped end 31 of the shank 30, and has a surrounding wall 41 surrounding the first axis (L1) and having a non-circular inner surface 41 to be disposed rearwardly of and in a spline engagement with the rear segment 11 of the handle 10 so as to rotate the rear segment 11 while permitting movement of the handgrip 40 relative thereto along the first axis (L1).

The retaining member 50 includes a mount seat 51 secured in the mounting recess 14, a latch 52 slidably sleeved on the mount seat 51 to be movable in the radial direction and having an end which is configured to engage the slot 34 for preventing rearward movement of the shank 30 (see FIG. 7), and a biasing member 53 disposed in the mounting recess 14 to bias the latch 52 towards the rear portion 131 of the passage 13.

The actuating member 60 is received in the operating hole 16, and includes a button 61 and a biasing member 62. The button 61 has an operated head 611 exposed outwardly and a depressing portion 612 extending towards the accommodation cavity 15 and depressable in the radial direction towards the access opening 150 so as to push the cassette member 20 in the radial direction, thereby facilitating removal of the cassette member 20 from the accommodation cavity 15. The biasing member 62 is disposed in the operating hole 16 to bias the button 61 away from the accommodation cavity 15.

Referring once again to FIG. 4, when the shank 30 is in the used position, the handgrip 40 is close to the intermediate segment 12 of the handle 10, and the engaging head 32 of the shank 30 engagingly pushes the selected tool bit 22 to extend outwardly of the front segment 17. In this state, the handgrip 40 can be operated to rotate the tool bit 22 for operating on a workpiece (not shown).

Figure 8:
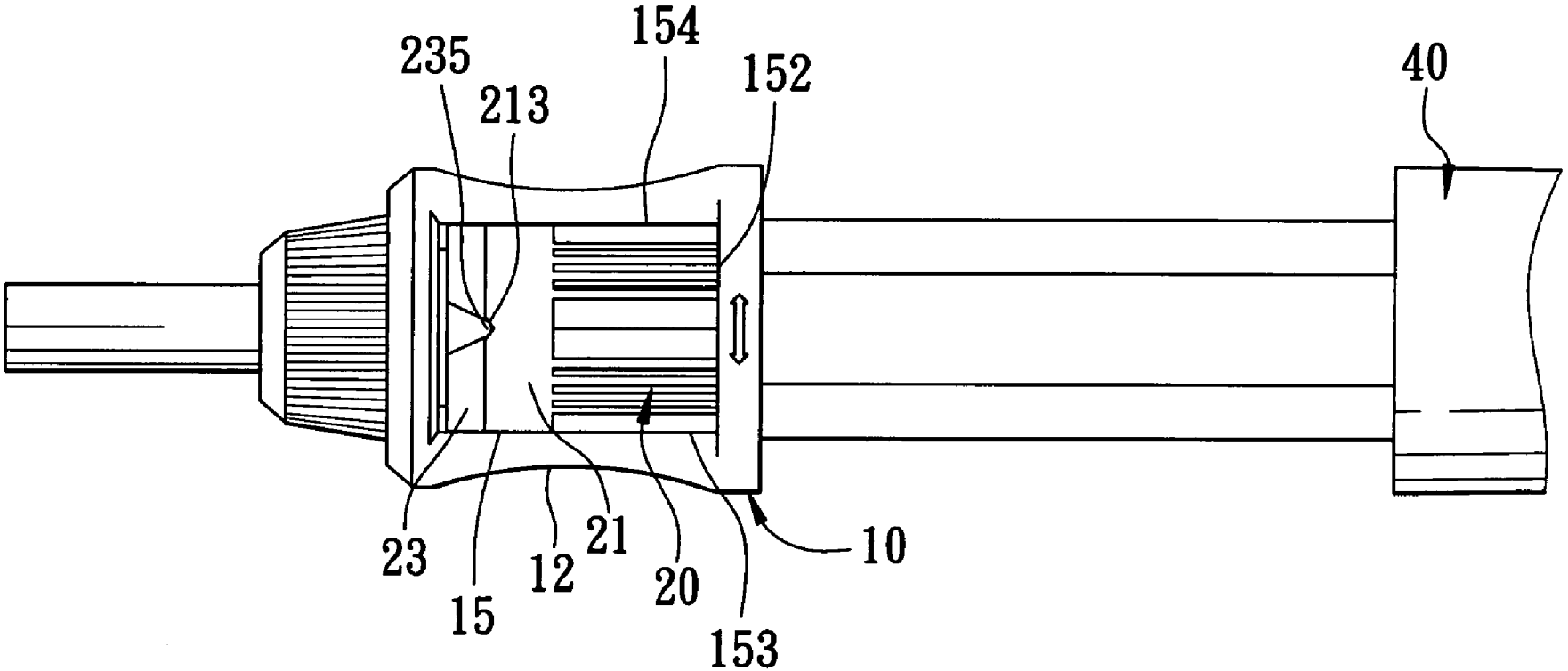
FIG. 8 is a fragmentary top view of the preferred embodiment, illustrating how an abutment seat is retained on a cylindrical body of the cassette member.
Figure 9:
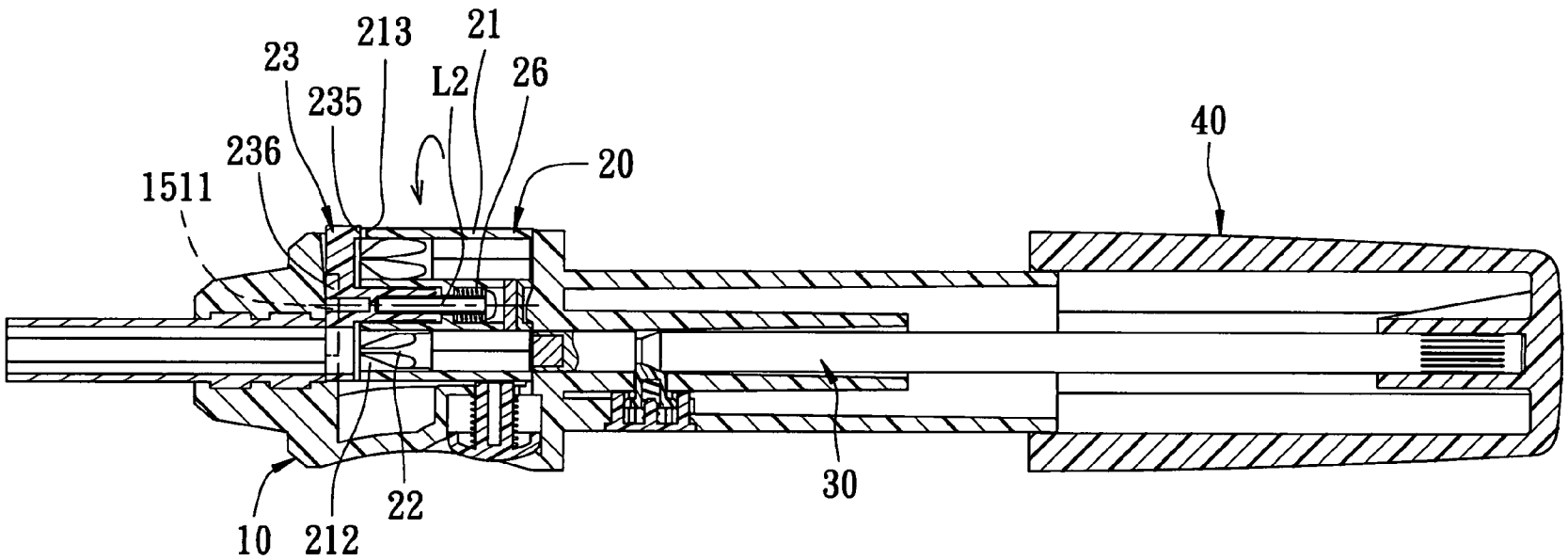
FIG. 9 is a sectional view of the preferred embodiment, illustrating how the cylindrical body is rotated relative to the abutment seat in the retracted state.
Figure 10:
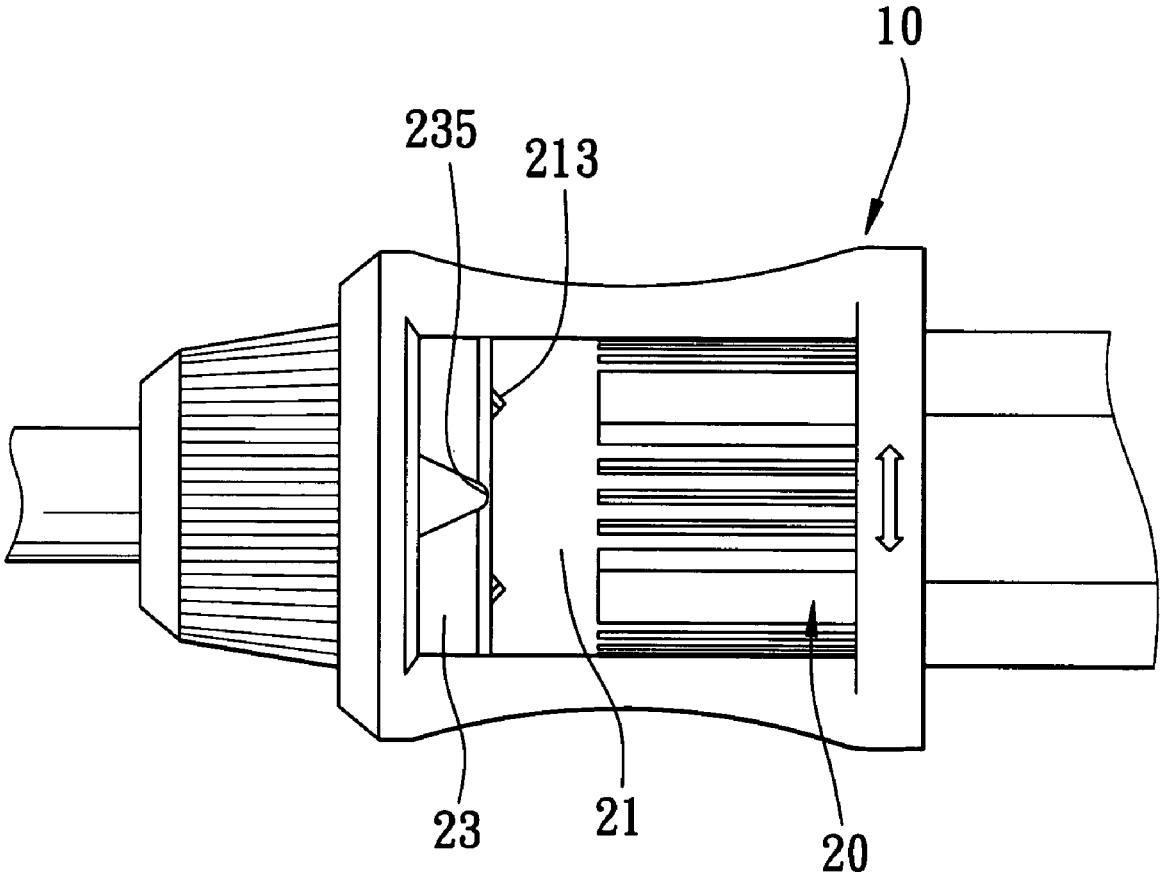
FIG. 10 is a fragmentary top view illustrating the cassette member in the state shown in FIG. 9.

Referring to FIGS. 7 and 8, when it is desired to rotate the cylindrical body 21 to change the selected tool bit 22 in the passage 13, the handgrip 40 is pulled rearwardly such that the shank 30 is displaced to a pick-up position, where the engaging head 32 extends into the selected storage chamber 212 to pick up the selected tool bit 22 for subsequent rearward movement to a retracted position. In the retracted position, the engaging head 32 retreats into the rear portion 131 of the passage 13, thereby leaving the selected tool bit 22 behind in the selected storage chamber 212. The end of the latch 52 is biased by the biasing member 53 to engage the slot 34 so as to retain the shank 30 relative to the handle 10 for preventing further rearward movement of the shank 30. Referring to FIGS. 9 and 10, the user can rotate the cylindrical body 21 about the second axis (L2) against the biasing action of the biasing member 26 to permit slippage of the protrusion 235 from the selected slot 213. When the desired tool bit 22 is in the standby position, the protrusion 235 is brought to engage the corresponding slot 213. Then, the handgrip 40 is pressed forwardly to bring the shank 30 to the pick-up position, where the engaging head 32 extends into the corresponding storage chamber 212 to pick up the desired tool bit 22 for subsequent forward movement to the used position (as shown in FIG. 4).

Figure 11:
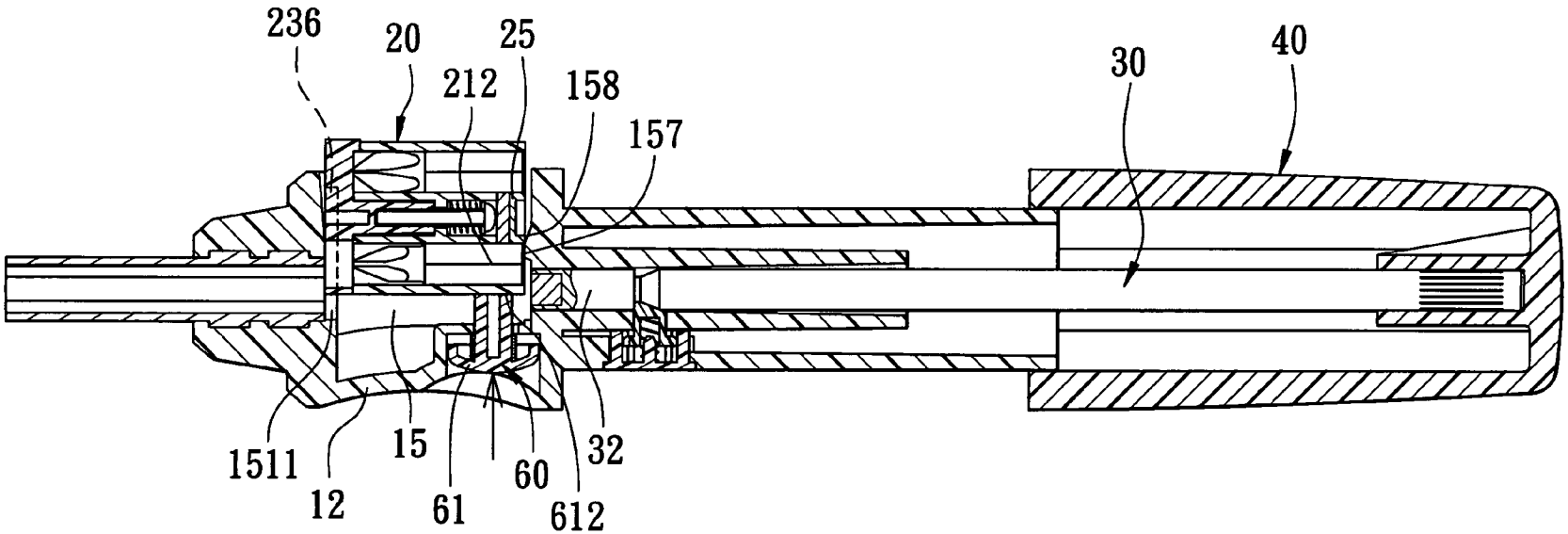
FIG. 11 is a sectional view of the preferred embodiment, illustrating how the cassette member is removed.

Referring to FIG. 11, when it is desired to remove the cassette member 20 from the accommodation cavity 15 for replacement, the shank 30 is pulled rearwardly to the retracted position, and the button 61 is then depressed to push the cassette member 20. The engaging portion 236 of the abutment seat 23 is configured to slide along the retaining recess 1511 in the front retaining wall 151, with the cap 25 sliding over the bump 157 of the retaining wall 152, thereby facilitating removal of the cassette member 20. Another cassette member 20 is inserted into the accommodation chamber 15 in such a manner that the engaging portion 236 is aligned with and engages the retaining recess 1511, and that the cap 25 is moved along the guiding inclined surface 158 to engage the bump 157.

As illustrated, a large amount of assorted tool bits 22 can be adapted for use with the hand tool of this invention. The operations of changing the tool bits 22 in the cassette member 20 and replacement of the cassette member 20 are convenient to conduct.

Figure 12:
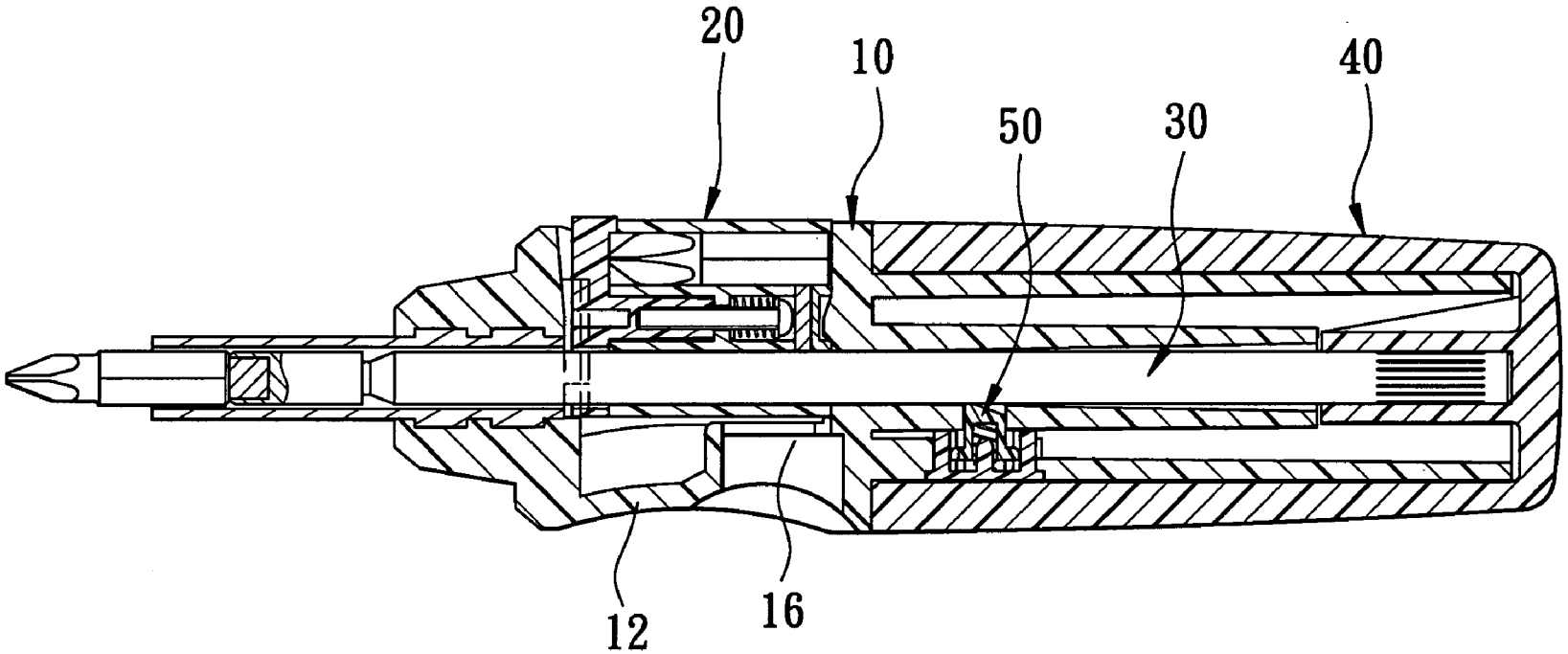
FIG. 12 is a sectional view of a modified preferred embodiment of this invention in a state of use.
Figure 13:
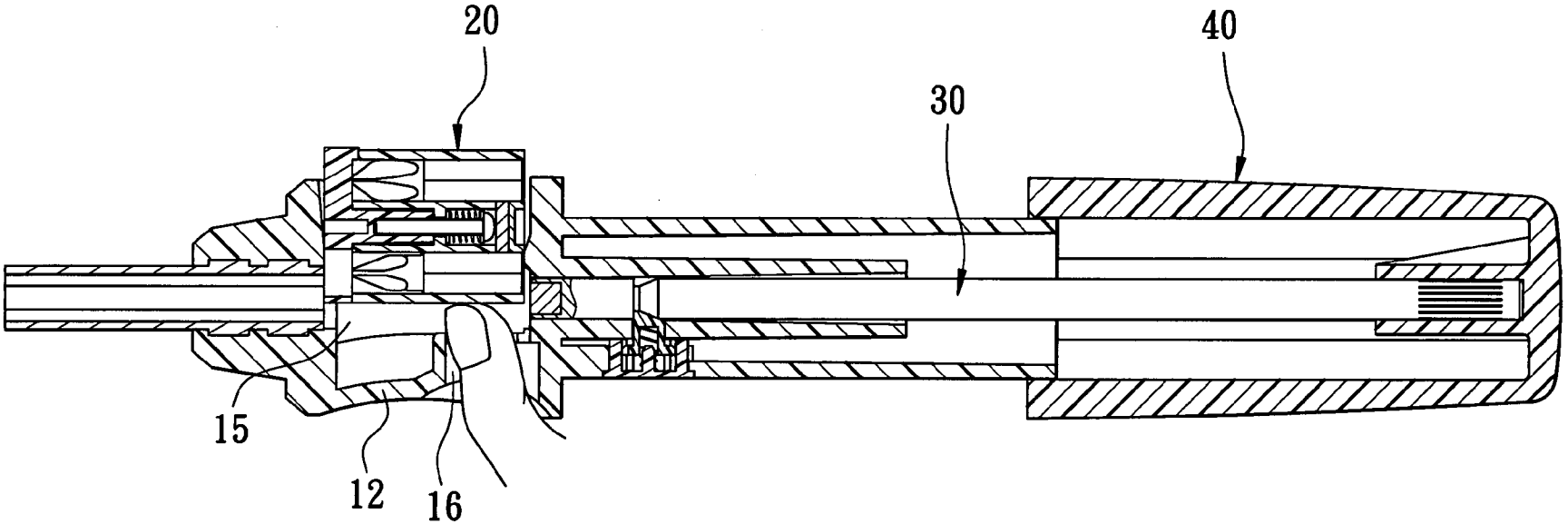
FIG. 13 is a sectional view of the modified preferred embodiment, illustrating how a cassette member thereof is removed.

Referring to FIGS. 12 and 13, a modified preferred embodiment of this invention is shown to be similar to the previous embodiment in construction with the exception that the actuating member 60 is dispensed with in this embodiment. Moreover, the operating hole 16 is configured to permit insertion of the user's finger into the accommodation cavity 15 so as to push the cassette member 20 outwardly.

While the present invention has been described in connection with what is considered the most practical and preferred embodiments, it is understood that this invention is not limited to the disclosed embodiments but is intended to cover various arrangements included within the spirit and scope of the broadest interpretations and equivalent arrangements.

I claim:

1. A hand tool comprising:

a handle which includes front and rear segments opposite to each other in a longitudinal direction, and an intermediate segment interposed between said front and rear segments, and which has a passage extending through said front, intermediate and rear segments along a first axis in the longitudinal direction, said intermediate segment having an access opening which extends in a direction radial to the first axis to be communicated with said passage so as to form an accommodation cavity, and an operating hole which is formed therethrough and opposite to said access opening in the radial direction and which is communicated with said accommodation cavity, said intermediate segment having front and rear retaining walls which are spaced apart from each other in the longitudinal direction to define a crossing path along the first axis;

a cassette member which is configured to be insertable through said access opening into said accommodation cavity, which is retained between and which is rotatable relative to said front and rear retaining walls about a second axis that is oriented in the longitudinal direction and offset from the first axis, and which has a plurality of storage chambers that are adapted to receive a plurality of tool bits, respectively, and that are displaced angularly from one another about the second axis such that when said cassette member is rotated about the second axis, said storage chambers are successively brought into said crossing path to have a selected one of said storage chambers in line with said passage, thereby placing a corresponding selected one of the tool bits in a standby position;

a shank which includes an engaging head and a gripped end opposite to each other in the longitudinal direction, and which is disposed in said passage to be displaceable among a used position, where said engaging head engagingly pushes the selected one of the tool bits, and extends outwardly of said front segment, a retracted position, where said engaging head retreats into said passage of said rear segment, thereby leaving the selected one of the tool bits behind in the selected one of said storage chambers, and a pick-up position, where said engaging head extends into the selected one of said storage chambers to pick up the selected one of the tool bits for subsequent forward movement to the used position or for subsequent rearward movement to the retracted position; and a handgrip which is configured to engage said gripped end, and which is disposed rearwardly of and which is movable relative to said rear segment in the longitudinal direction to thereby bring said shank to one of the used, pick-up and retracted positions.

2. The hand tool of claim 1, wherein said passage at said front segment of said handle has a non-circular cross-section to be adapted to conform with a cross-section of each of the tool bits, said engaging head of said shank having a magnet provided thereon and facing forwards so as to be adapted for magnetic attraction with the selected one of the tool bits in the standby position.

3. The hand tool of claim 2, wherein said handgrip is in a spline engagement with said rear segment of said handle so as to rotate said rear segment while permitting movement of said handgrip relative thereto along the first axis.

4. The hand tool of claim 3, further comprising a retaining member disposed to retain said shank relative to said handle when said shank is in the retracted position so as to prevent rearward movement of said shank.

5. The hand tool of claim 4, wherein said rear segment of said handle has a mounting recess extending from said passage in a direction radial to the first axis, said retaining member including a slot which is formed in said engaging head, a latch which is disposed in said mounting recess, which is movable in the radial direction, and which has an end configured to engage said slot when said shank is in the retracted position so as to prevent the rearward movement of said shank, and a biasing member which is disposed in said mounting recess to bias said latch towards said slot.

6. The hand tool of claim 1, further comprising an actuating member including a button which is disposed in said operating hole and which is depressable in the radial direction towards said access opening so as to push said cassette member in the radial direction to thereby facilitate removal of said cassette member from said accommodation cavity, and a biasing member which is disposed to bias said button away from said accommodation cavity.

7. The hand tool of claim 1, wherein said cassette member includes an abutment seat having an engaging part which frictionally engages said front retaining wall to prevent rotation of said engaging part relative thereto about the second axis, and a stem which extends from said engaging part along the second axis, said engaging part having an eccentric through hole relative to the second axis that is in line with said passage, a cylindrical body having an outer periphery which surrounds the second axis, and an axial mounting hole for mounting rotatably said cylindrical body on said stem, said storage chambers being formed between said outer periphery and said axial mounting hole and which extend in the longitudinal direction such that the selected one of said storage chambers is in line with said eccentric through hole, and a biasing member disposed to bias said cylindrical body towards said abutment seat.

8. The hand tool of claim 7, wherein said cassette member further includes a protrusion formed on and projecting rearwardly from said engaging part, and a plurality of slots formed in said outer periphery of said cylindrical body and angularly displaced from one another about the second axis such that said protrusion is brought to engage a selected one of said slots by biasing action of said biasing member so as to position the selected one of said storage chambers in said crossing path.

9. The hand tool of claim 8, wherein said cassette member further includes a magnet which is disposed in said axial mounting hole and which has an outer peripheral wall exposed to said storage chambers so as to be adapted for magnetic attraction with the tool bits received in said storage chambers.

* * * * *